US007614205B2

(12) United States Patent
Conti

(10) Patent No.: US 7,614,205 B2
(45) Date of Patent: Nov. 10, 2009

(54) UNIT FOR FEEDING INFUSION MATERIAL TO A MACHINE PRODUCING FILTER PACKS

(75) Inventor: Roberto Conti, Imola (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 366 days.

(21) Appl. No.: 10/569,736

(22) PCT Filed: Jun. 30, 2005

(86) PCT No.: PCT/IB2005/002005

§ 371 (c)(1),
(2), (4) Date: Feb. 28, 2006

(87) PCT Pub. No.: WO2006/008624

PCT Pub. Date: Jan. 26, 2006

(65) Prior Publication Data

US 2008/0196359 A1 Aug. 21, 2008

(30) Foreign Application Priority Data

Jul. 16, 2004 (IT) ..... BO2004A0442

(51) Int. Cl.
*B65B 47/04* (2006.01)

(52) U.S. Cl. ..... 53/559; 53/122; 53/433; 53/453; 53/527; 53/561

(58) Field of Classification Search ..... 53/122, 53/433, 453, 527, 528, 553, 559, 561
See application file for complete search history.

(56) References Cited

U.S. PATENT DOCUMENTS

| | | | | |
|---|---|---|---|---|
| 2,603,927 | A | 7/1952 | Gray | |
| 4,024,694 | A * | 5/1977 | Cooper et al. | 53/282 |
| 4,437,294 | A * | 3/1984 | Romagnoli | 53/553 |
| 4,555,894 | A * | 12/1985 | Illy | 53/528 |
| 4,609,556 | A * | 9/1986 | Goedert | 426/394 |
| 4,747,250 | A * | 5/1988 | Rossi | 53/511 |
| 5,649,412 | A * | 7/1997 | Binacchi | 53/559 |
| 5,791,127 | A * | 8/1998 | Rossi | 53/559 |
| 6,470,921 | B1 | 10/2002 | McGregor | |

FOREIGN PATENT DOCUMENTS

| | | | |
|---|---|---|---|
| EP | 0 144 623 | A2 | 6/1985 |
| EP | 0 943 544 | A1 | 9/1999 |
| WO | WO 99/47423 | A2 | 9/1999 |
| WO | WO 2005/120957 | A1 | 12/2005 |

* cited by examiner

*Primary Examiner*—Thanh K Truong
(74) *Attorney, Agent, or Firm*—Arent Fox LLP

(57) ABSTRACT

Described is a unit (1) for feeding powdered infusion material to a machine (M) producing packs (3) made from filter material (5). The machine (M) comprises a production line (2) for making such packs (3) and consists of a conveyor (4) with mobile recesses (7) moving in a feed direction (L) designed to be covered with filter material (5) and to form impressions (8) in the filter material (5); rotary feeders (10) fitted to the unit (1) designed to feed an amount or dose (C) of the powdered infusion material into the impressions (8), and rotary precompactors (14) mounted on the rotary feeders (10) acting together with rotary feeders (10) to distribute the doses (C) uniformly inside the impressions (8).

5 Claims, 3 Drawing Sheets

UNIT FOR FEEDING INFUSION MATERIAL TO A MACHINE PRODUCING FILTER PACKS

TECHNICAL FIELD

This invention relates to a unit for feeding infusion material to a machine producing packs made from filter material.

In particular, the present invention can be advantageously employed to feed powdered, ground coffee to an automatic packing machine designed to produce coffee "pods" made from filter paper. The description below makes explicit reference to this embodiment without restricting the scope of the invention.

BACKGROUND ART

At the present time, feeding powdered coffee to machines which make and fill filter-paper coffee pods is performed by a unit fitted to the machine itself where the unit consists of feeder devices designed to drop an amount of coffee into a dosing chamber.

The dosing chamber is horizontal and inside has a sliding, reciprocating piston designed to push the dose of coffee dropped down by the feeders into a vertical feed tube from where the coffee drops down into a series of circular filter paper impressions; the impressions are formed by embossing a strip of filter paper on a corresponding series of circular recesses on an intermittent conveyor which forms the pod shaping and conveying line of the packing machine.

Vertical, reciprocating pressers are mounted at the feed tube and compress the coffee in the circular impressions before the impressions are covered on the top with a strip of filter paper in order to close and complete the pod.

A serious drawback to the feeding-dosing unit described above is that the powdered coffee is not distributed uniformly inside the circular pod impressions.

The principal cause of this drawback is the fact that the coffee, pushed by the piston element in the feed tube, drops down into the impressions in an uncontrolled and uneven manner and not even the action of the pressers is able to distribute the coffee uniformly in the impressions.

The result using the type of feeder-doser described above is a coffee pod which does not meet quality specifications.

This considerable drawback worsens as the operating speed of the pod maker-filler machine increases.

The aim of the present invention is to produce a feeder unit which overcomes the drawbacks cited above.

In particular, the aim of the present invention is to produce a coffee feeder unit for a packing machine that produces filter paper coffee pods of the specified quality and which operates at high production speeds.

DISCLOSURE OF THE INVENTION

The present invention describes a unit for feeding infusion material to a machine producing packs made from filter material. The machine comprises a production line for making such packs and consists of a conveyor with mobile recesses moving in the feed direction and designed to be covered with filter material in order to form impressions in the filter material. The unit is characterised in that it comprises rotary feeders designed to feed an amount or dose of infusion material into the impressions, and rotary precompactors mounted on the rotary feeders acting together with the rotary feeders to distribute the doses uniformly inside the impressions.

BRIEF DESCRIPTION OF THE DRAWINGS

The technical characteristics of the invention, with reference to the above aims, are clearly described in the claims below and its advantages are apparent from the detailed description which follows, and from the accompanying drawings which illustrate a preferred embodiment of the invention provided merely by way of example without limiting the scope of the inventive step, and in which:

DETAILED DESCRIPTION OF THE PREFERRED EMBODIMENTS OF THE INVENTION

Figure 1:
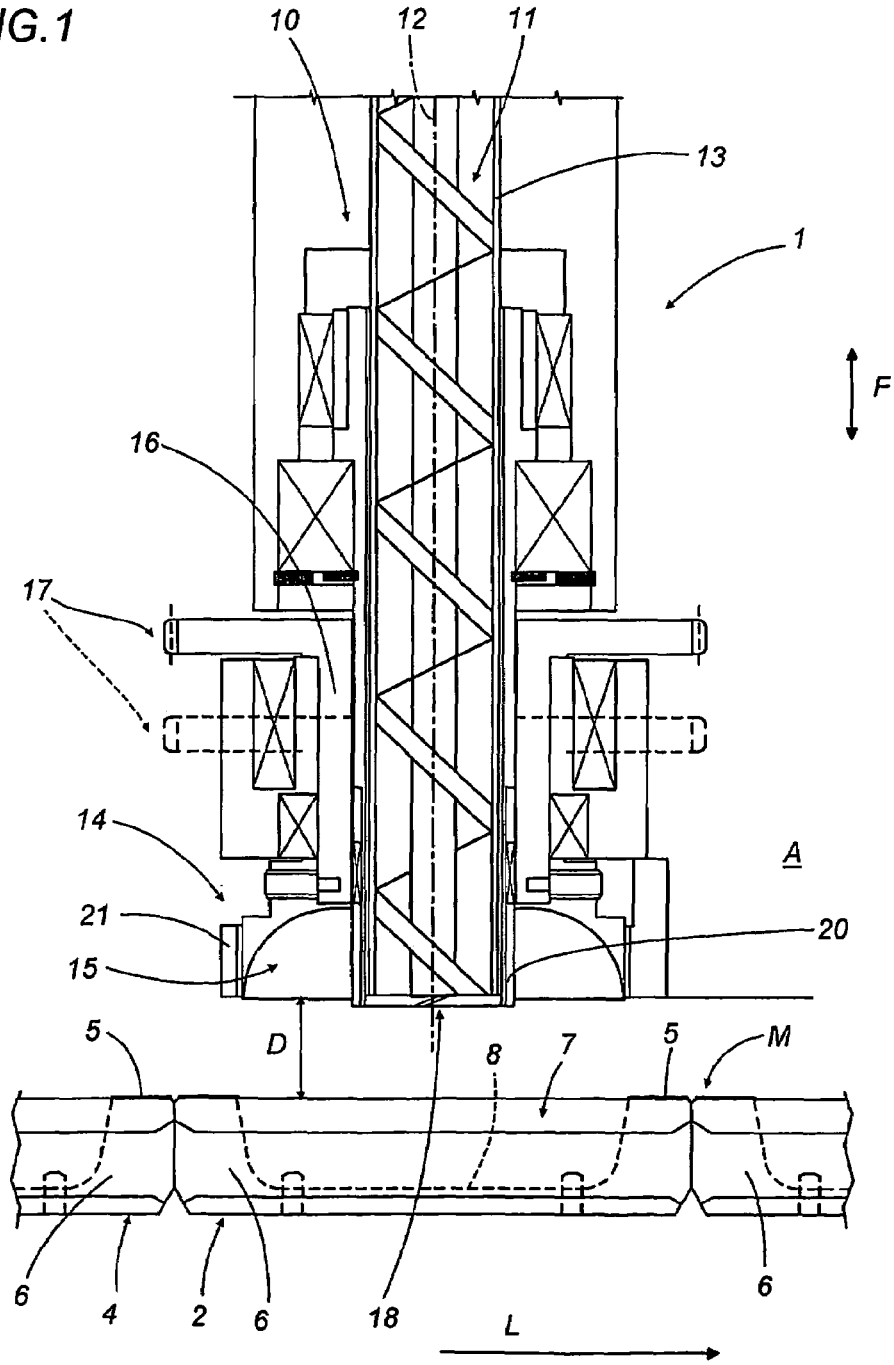
FIG. 1 is a front view, with some parts cut away and others in cross section to better illustrate certain details, of an embodiment of the feeder unit in a first operating position.
Figure 4:
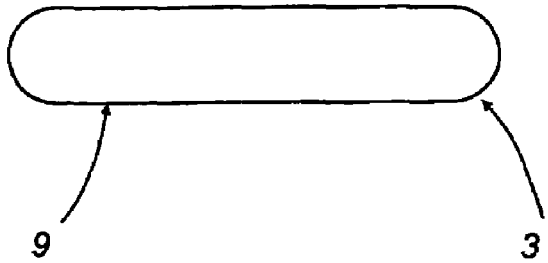
FIG. 4 is front view of an infusion material pack filled by the feeder unit described in this invention.

With reference to FIG. 1, the numeral 1 indicates a feeder unit for feeding powdered, ground coffee to the production line 2 of a packing machine M producing coffee pods 3 (FIG. 4) made from filter paper, the feeder unit 1 being an integral part of this machine.

The production line 2 comprises a intermittent-motion conveyor 4 moving in a horizontal feed direction L carrying a filter-paper strip 5, and having a series of modular elements 6.

Each modular element 6 has at least one, mobile circular recess 7 moving in the direction L and designed to make a corresponding circular impression 8 in the filter paper (dashed line in FIG. 1). The impression is formed, using a known embossing method not illustrated here, by pressing the strip 5 into the recess 7 in order to form the lower portion or half-shell 9 (FIG. 4) of the pod 3 being formed by the machine.

Figure 2A:
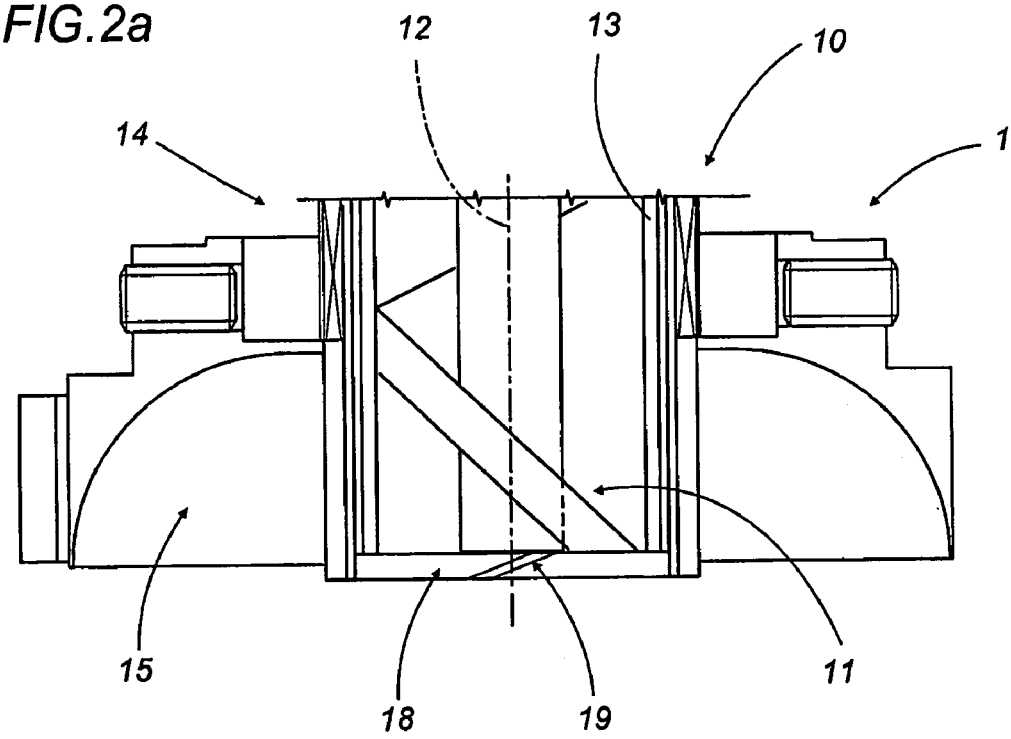
FIGS. 2*a* and 2*b* are enlarged views of the unit in FIG. 1 as seen from the front and from above respectively.
Figure 3:
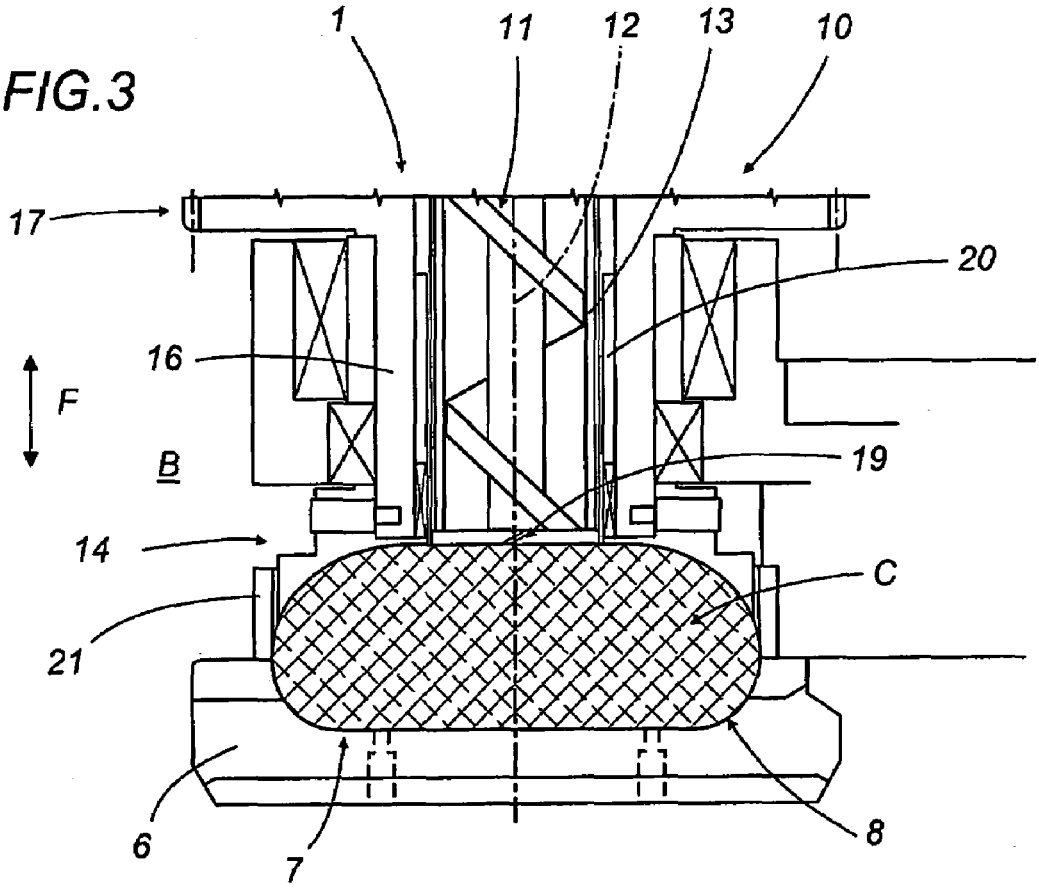
FIG. 3 is a front view, with some parts cut away and others in cross section to better illustrate certain details, of the feeder unit in FIG. 1 in a second operating position.

FIGS. 1, 2*a* and 3 show a feeder unit 1 consisting of rotary feeders 10 in the form of a feed screw 11 rotating about a vertical axis 12 inside a hollow, tubular, cylindrical container 13 and designed to feed a specified amount or dose C of powdered coffee into the impressions 8 of the conveyor 4 of the line 2.

The cylindrical container 13 is mounted at a distance D from the conveyor 4 (FIG. 1) and supports, on its outer surface, a sliding precompactor 14.

FIGS. 1 and 3 show the precompactor 14 which consists of a hollow, ring-shaped cap 15 fixed to a hollow, cylindrical, tubular element 16.

One end 17 of the tubular element 16 is designed to engage with the gear wheel (not shown here) of a motor unit (also not shown here) which rotates the tubular element around the cylinder 13 on special bearings and around the axis 12; the tubular element also slides vertically (arrow F in FIGS. 1 and 3) on the cylinder 13 between a rest position A, where the cap 15 is positioned at a distance from the conveyor 4 substantially the same as the distance D (FIG. 1), and an operating position B where the cap 15 is designed to act on the upper portion of the powdered coffee dose C fed into the pod impression 8 by the feed screw 11 in order to aid the uniform distribution of the dose C (FIG. 3) by levelling it out uniformly inside the impression 8.

Figure 2B:
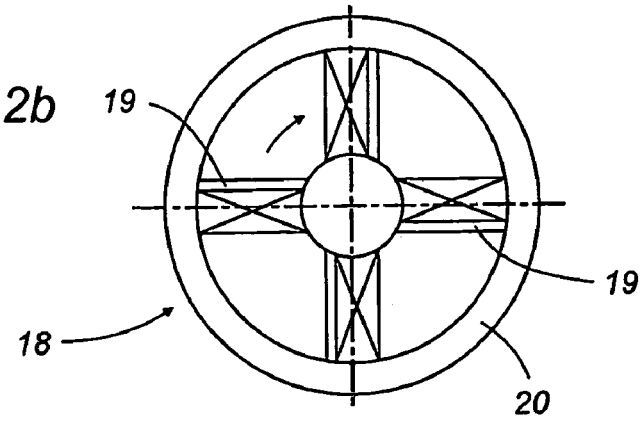

FIGS. 2*a* and 2*b* show the end of the feed screw 11 where there is a separator 18 consisting of blades 19 extending radially at one end of a rotary cylinder 20 which rotates around the cylinder 13 which in turn rotates, independent of the feed screw 11 action, together with the tubular element 16 to which it is connected. The rotary blades 19 are designed to act on the coffee dose C in the impression 8 already distributed uniformly by the action of the rotary cap 15 and thereby produce a dynamic separation between the dose C and the lower end of the screw feed 11.

The blades 19 are rotated together with the precompactor 14 by the tubular element 16 to which they are both connected and rotate together with the feed screw 11 to aid the flow of coffee downwards towards the impressions 8 when the feed screw 11 itself is rotating; when the feed screw 11 stops rotating, the blades 19 continue to rotate thus producing a dynamic separation.

In practice, when the filter paper impression 8 on the module 6 of the conveyor 4 is under the feed screw 11 during an operating cycle, the tubular element 16 slides downwards from position A to position B and, at the same time, rotates around the cylinder 13. This has the effect of rotating the feed screw 11 of the unit 1 so that a coffee dose C drops down into the impression 8.

In position B, the rotary cap 15 presses down and rotates on the upper part of the dose C currently being formed thus effectively and uniformly precompacting the dose C being formed so that it is uniformly distributed inside the impression 8; a paper presser 21 mounted on the element 14 holds and stabilises the filter paper strip 5 while the dose C is being compacted.

When the screw feed 11 stops rotating this stops the flow of coffee powder, the blades 19 of the separator-leveller 18 continue to rotate thus separating the dose C from the feed screw 11.

At the end of the cycle, the tubular element 16 travels upwards carrying the cap 15 of the precompactor 14 back to the home position A. The impression 8, now filled with the precompacted dose C, moves forward towards another presser element (of a known type and not shown here) which completes compaction of the dose C after the conveyor 4 feeds forward by one step in the direction L. The next impression 8 is now in position under the feed screw 11 ready to be filled with a new dose from the feeder unit 1.

The invention described here may be subject to modifications and variations without thereby departing from the scope of the inventive concept; all the details of the invention may be substituted by technically equivalent elements.

The invention claimed is:

1. A unit for feeding infusion material to a machine producing packs made from filter material wherein the machine comprises:

a production line for such packs including a conveyor having modular elements, each modular element having a recess, wherein the modular elements move in a specified feed direction and carry a filter material, and wherein the recesses form impressions in the filter material;

at least one rotary feeder comprising a hollow and tubular container positioned transversely across the feed direction at a fixed distance from the conveyor of the production line, and a feed screw rotating inside the tubular container for feeding an amount or dose of infusion material into the impressions;

at least one rotary precompactor acting together with the at least one rotary feeder to distribute the doses uniformly inside the impressions, said at least one rotary precompactor rotating around an exterior surface of the tubular container of the at least one rotary feeder and sliding on the exterior surface of the tubular container of the at least one rotary feeder towards and away from an operating position where the precompactor is in contact with at least one of the doses already inside one of the impressions.

2. A unit according to claim 1 wherein the at least one precompactor comprises a hollow, ring-shaped cap fixed to a hollow, cylindrical, tubular element which is designed to rotate around and slide up the cylindrical container of the feed screw.

3. A unit according claim 1 wherein the at least one rotary feeder supports a separator-leveler device fitted with rotary blades designed to act on the doses.

4. A unit according to claim 3, wherein the rotary blades are designed to produce a dynamic separation between the doses and the at least one rotary feeder.

5. A unit for feeding infusion material to a machine producing packs made from filter material, wherein the machine comprises a production line for such packs including a conveyor having modular elements, each modular element having a recess, wherein the modular elements move in a specified feed direction and carry a filter material, and wherein the recesses form impressions in the filter material; the unit further comprising a rotary feeder designed to feed an amount or dose of infusion material into the impressions and a rotary precompactor mounted on the rotary feeder and acting together with the rotary feeder to distribute the doses uniformly inside the impressions; the rotary feeder supporting separator-leveler devices fitted with rotary blades designed to act on the doses.

* * * * *